US005975193A

United States Patent [19]

Tokita et al.

[11] Patent Number: 5,975,193

[45] Date of Patent: Nov. 2, 1999

[54] HEAT EXCHANGER

[75] Inventors: Hideo Tokita, Utsunomiya; Shinji Ito, Oyama; Toshinori Tokutake, Oyama; Kanji Takasaki, Utsunomiya; Katsuyuki Takahashi, Chiba, all of Japan

[73] Assignee: Showa Aluminum Corporation, Osaka, Japan

[21] Appl. No.: 08/621,898

[22] Filed: Mar. 26, 1996

Related U.S. Application Data

[63] Continuation of application No. 08/185,947, filed as application No. PCT/JP93/00585, Apr. 30, 1993, abandoned.

[30] Foreign Application Priority Data

May 22, 1992 [JP] Japan ..... 4-131152

[51] Int. Cl.[6] ..... F28F 9/16

[52] U.S. Cl. ..... 165/79; 165/178

[58] Field of Search ..... 165/173, 178, 165/76, 79; 29/890.054; 228/138, 154, 183, 189; 285/287, 289.1

[56] References Cited

U.S. PATENT DOCUMENTS

| | | | |
|---|---|---|---|
| 1,280,311 | 10/1918 | Scheeland | 285/287 X |
| 2,249,469 | 7/1941 | Gray et al. | 285/287 X |
| 3,440,391 | 4/1969 | Apblett | 165/173 X |
| 3,782,450 | 1/1974 | Swozil | 165/173 X |
| 4,586,566 | 5/1986 | Kern et al. | 165/79 X |
| 4,679,960 | 7/1987 | Mizuhara | 228/154 X |
| 5,101,889 | 4/1992 | Potier | 228/183 X |
| 5,228,727 | 7/1993 | Tokutake et al. | 165/178 X |

FOREIGN PATENT DOCUMENTS

| | | | |
|---|---|---|---|
| 85863 | 12/1948 | Japan . | |
| 59247 | 5/1975 | Japan . | |
| 181095 | 7/1989 | Japan . | |
| 79994 | 4/1991 | Japan . | |
| 93592 | 4/1993 | Japan | 165/176 |
| 535415 | 5/1973 | Switzerland | 165/178 |

*Primary Examiner*—Leonard Leo

[57] ABSTRACT

A heat exchanger is made of a metal such as aluminum and for use in the air conditioning apparatuses such as the car coolers and the room air conditioners. A coolant inlet pipe (6) has an end which is forced into a pipe insertion bore (10) of a pipe joint (8) for connection to an external piping, with a cylindrical brazing agent piece (15) being interposed between the outer periphery of the inlet pipe end and the inner peripheral wall of the bore, such that the pipe (6) is brazed integral to the joint (8) by means of the cylindrical piece (15). This cylindrical brazing agent piece (15) is composed of a core layer which has an outer and inner surfaces clad with a brazing agent layer. The pipe (6) and the joint (8) can be preassembled without failing to interpose between them the brazing agent piece (15), so that said pipe and said joint can be brazed one to another surely and at a lowered cost.

15 Claims, 7 Drawing Sheets

HEAT EXCHANGER

This application is a continuation of application Ser. No. 08/185,947, filed Jan. 18, 1994, now abandoned, which is 371 of PCT/JP93/00585, filed Apr. 30, 1993.

TECHNICAL FIELD

The present invention relates to a heat exchanger which is made of a metal such as aluminum and for use as the heat exchanger employed in the air conditioning system such as the car cooler and room air conditioner.

BACKGROUND ART

The heat exchangers for use in the air conditioning system generally comprise coolant pipes which extend from a heat exchanger body, wherein each coolant pipe has at its end a pipe joint to be connected to an external pipings.

Usually, the coolant pipes are seam-welded pipes which are made from an aluminum brazing sheet having its outer surface clad with a brazing agent layer. In such a case, the pipe joint has heretofore been adjoined to the coolant pipe in such a manner that the end thereof is forcibly inserted into a pipe receiving hole of the joint so as to be self-retained therein. In the subsequent brazing process, the brazing agent layer clad on the pipe outer surface is utilized to make the coolant pipe integral with the pipe joint.

It has however been a problem that the coolant pipe adjoined to the pipe joint is expensive if it is a clad pipe such as the seam welded pipe made of the brazing sheet, thus raising the manufacture cost of the heat exchanger. This problem would be serious where the coolant pipe has to be excessively long due to a certain arrangement of the external pipings.

Recently, a bare pipe 51 which is not clad with any brazing agent was therefore proposed for use as the coolant pipe in an improved junction as shown in FIG. 10. The bare pipe is for example an inexpensive extruded aluminum pipe having a beaded portion 52. An end of the pipe 51 is put into a pipe receiving bore 55 formed in a pipe joint 53, with a brazing agent ring 54 being sandwiched between the beaded portion 52 and the joint 53, before brazed one to another in this state.

Since the end of the pipe 51 is tightly forced into the bore 55 of the joint 53, they can stand immovable relative to each other in a temporary assembly even if the brazing agent ring 54 would be missed. Consequently, the temporary assemblies devoid of the brazing agent ring 54 have occasionally been subjected to the brazing process within an oven, causing an incompletely brazed product. In addition, a flux covering the adjoined portion of the product taken out of the oven makes it difficult to judge whether the brazing is complete or not. Further, since the flux per se does behave as a poor agent to braze the adjacent members, there is a possibility that an incompletely brazed product erroneously passes the following leak test.

In view of the problems inherent in the prior art heat exchangers, an object of the present invention is to provide a heat exchanger which comprises a heat exchanger body, connection pipes each extending therefrom for flowing a heat exchanging medium, and a pipe joint attached to at least one of external pipings, wherein the pipe joint is affixed securely and inexpensively to one of the connection pipes.

DISCLOSURE OF INVENTION

According to the present invention, a heat exchanger comprises a heat exchanger body, a connection pipe extending therefrom for flowing a heat exchanging medium, and a pipe joint attached to the external piping and having a cylindrical bore for receiving an end portion of the connection pipe, and the heat exchanger is characterized in that it further comprises a cylindrical brazing agent piece interposed between the outer periphery of the end portion and the inner periphery of the bore, wherein the end portion of the connection pipe is forcibly and tightly fitted in the cylindrical bore and is brazed integral therewith due to the interposed cylindrical brazing agent piece.

The end of connection pipe in this structure is pressed into engagement with the cylindrical bore in the pipe joint, with the cylindrical brazing agent piece thereby intervening the outer periphery of said end and the inner periphery of said bore, in such a manner that a failure of the cylindrical piece does hinder the pipe end from being fixed in the joint to form a stable preassembly. Thus the cylindrical brazing agent piece will not be missed when connecting the pipe to the joint, whereby any preassembly lacking the brazing agent is prevented from entering the brazing oven. In other words, it is now ensured that the connection pipes are brazed to the pipe joints without failure.

BRIEF DESCRIPTION OF THE DRAWINGS

FIG. 1 shows the connection of a coolant inlet pipe to a pipe joint for external pipe in an embodiment, in which.

FIG. 2 illustrates another embodiment, in which.

FIG. 4 illustrates still another embodiment, in which.

FIG. 7 illustrates a still further embodiment, in which.

FIG. 9 shows a heat exchanger in its entirety, in which.

BEST MODE OF CARRYING OUT THE INVENTION

Some embodiments will now be described, wherein the present invention is applied to the so-called multi-flow type or parallel flow type condenser which is made of aluminum for use in the car cooler. It will be understood that this invention is applicable also to other various heat exchangers including those for use in the room air conditioners or as the oil coolers, and those of the so-called serpentine type having a core composed of a single tube which is repeatedly bent in a meandering manner.

Figure 9A:
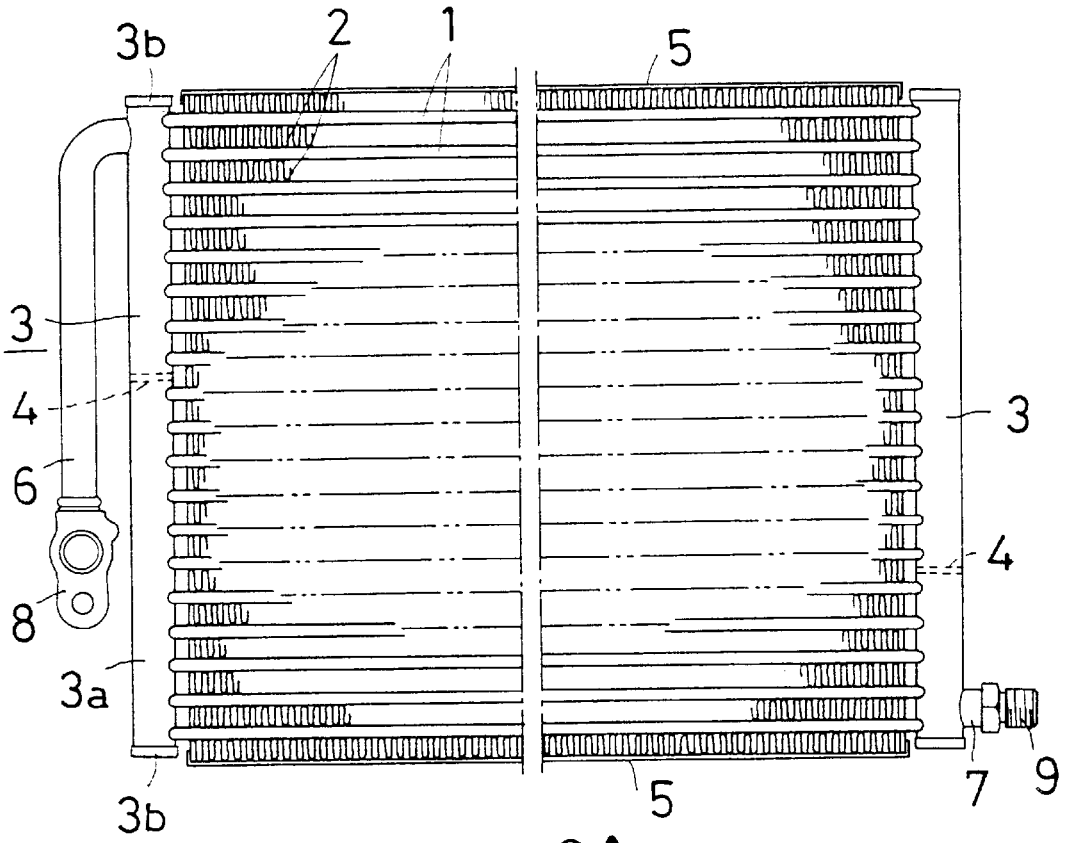
FIG. 9A is a front elevation.
Figure 9B:
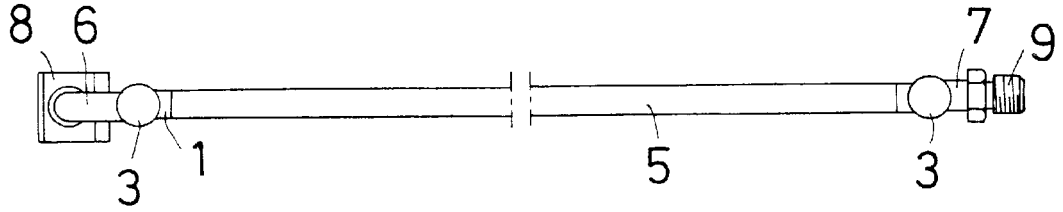
FIG. 9B is a plan view.
Figure 10:
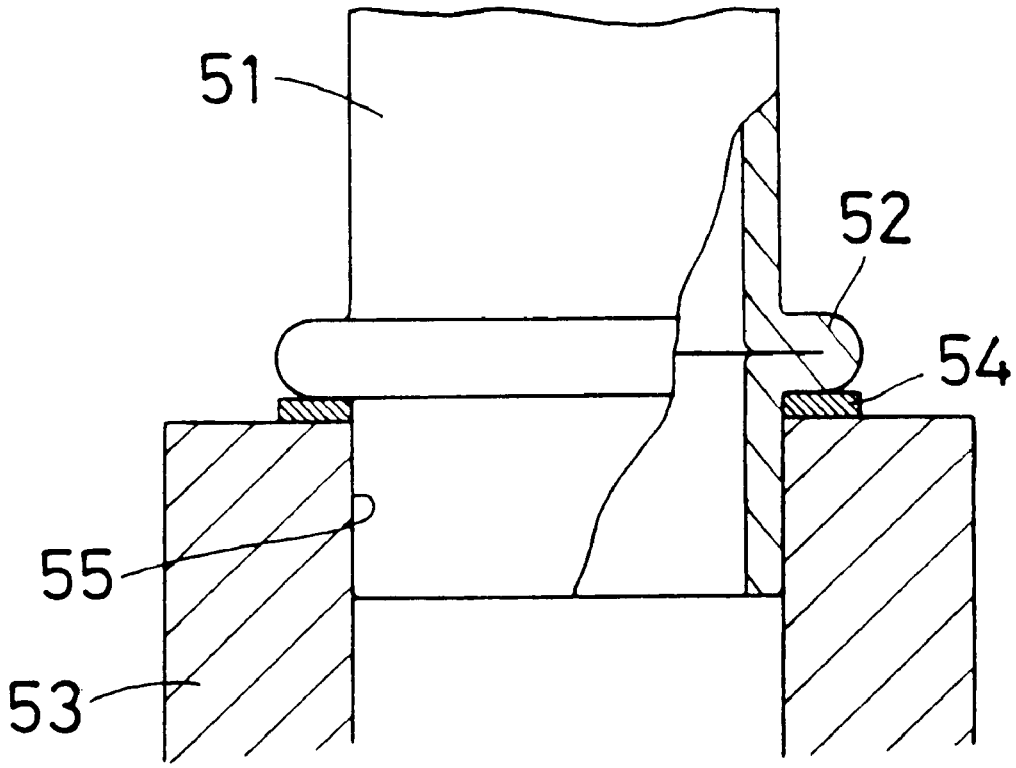
FIG. 10 PRIOR ART
FIG. 10 is a vertical cross section of an inlet pipe connected to a pipe joint in the prior art structure.

In FIG. 9 showing a heat exchanger, the reference numeral 1 denotes flat tubes, and the number 2 denotes corrugated fins, wherein the tubes and the corrugated fins extend in parallel to alternate with one another in the vertical direction. A pair of left and right hollow headers 3 and 3 are connected to ends of each flat tube 1 in fluid communication therewith. The further reference numeral 4 denotes partitions each dividing the interior of the header 3 at a given height thereof into chambers such that a coolant may flow through the groups of tubes 1 successively in a meandering manner. Side plate 5 and 5 are disposed outside the uppermost and lowermost fins 2, respectively, so as to protect them.

A coolant inlet pipe 6 and a coolant outlet pipe 7 are respectively connected to the headers 3 and 3. The reference numeral 8 denotes a pipe joint which is of the flange-connection type and attached to the end of the inlet pipe 6, with the numeral 9 denoting a further pipe joint which is of the flaring connection type and attached to the outlet pipe 7.

Each flat tube 1 as one of the members which construct the heat exchanger as described above is the so-called harmonica tube, which is an extruded aluminum profile having its interior divided into some longitudinal compartments defined between internal partitioning walls, so that pressure resistance of the tube is improved. The flat tube may not be the extruded one but be a seam welded pipe or the like.

Each fin 2 is a strip which is cut from a sheet and of the same width as the tube 1, and the strip is bent into a corrugated shape and having portions opened up as louvers. The sheet is an aluminum brazing sheet having a core which is clad with a brazing agent layer.

Each header 3 is composed of a cylindrical header pipe 3*a* and aluminum header caps 3*b* which are fitted on an upper and lower open ends of the pipe, wherein the header pipe 3*a* is fabricated by using an aluminum brazing sheet having one or both surfaces clad with a brazing agent layer, and by bending the sheet such that its lateral sides abut against one another to form a cylindrical pipe. Each header 3 comprises a row of tube-insertion apertures for receiving ends of the tubes 1, in addition to a pipe-insertion aperture formed at a given position for receiving a foot end of the inlet pipe 6 or outlet pipe 7. Alternatively, the header pipes 3*a* may be those which are made by the seam welding or extrusion method.

Figure 1A:
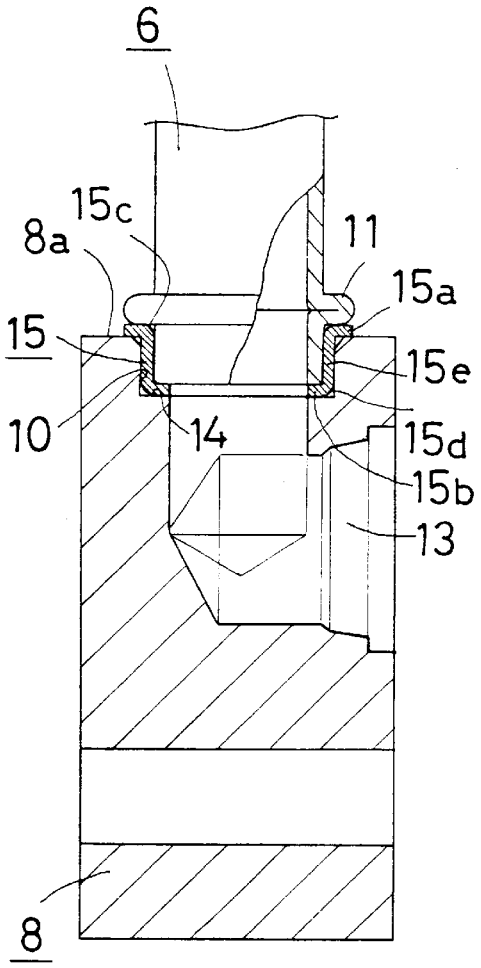
FIG. 1A is a vertical cross section of the connection.
Figure 1B:
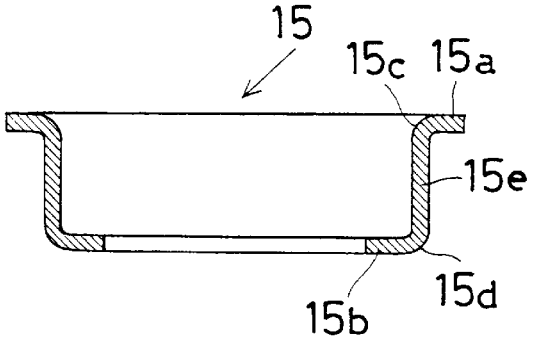
FIG. 1B is a vertical cross section of a cylindrical brazing agent piece used therein.
Figure 1C:
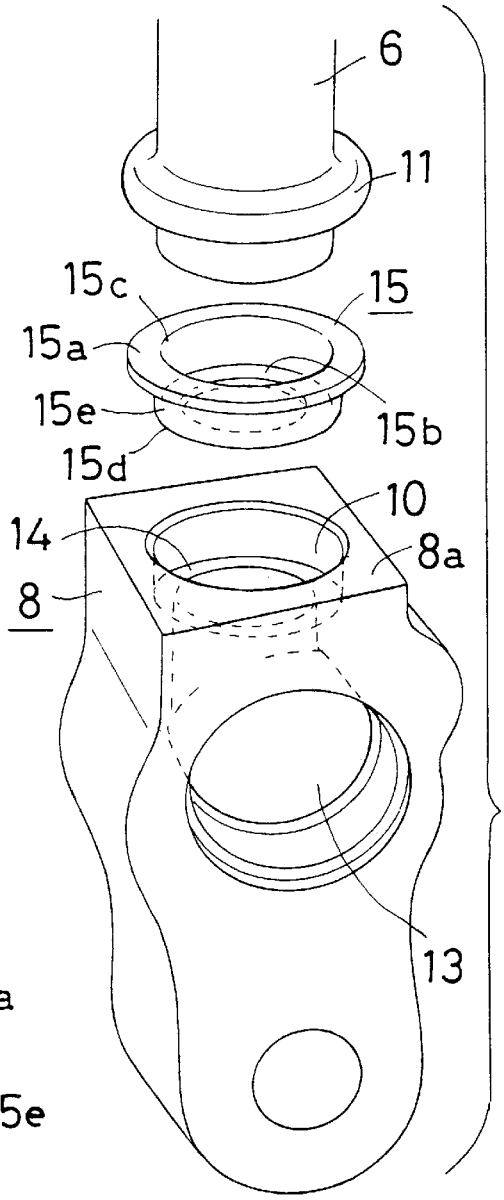
FIG. 1C is a perspective view showing, in disassembled state, the inlet pipe, the pipe joint and the cylindrical piece.

The coolant inlet pipe 6 is an aluminum bare pipe which is made by the extrusion or by the drawing method and has its surface not clad with any brazing agent layer, and is comparatively long to mate an external pipe and has a bent portion adjacent to the foot end. As shown in FIG. 1, a beaded portion 11 which is formed near an extremity of the inlet pipe 6 does protrude radially and outwardly from the outer periphery thereof.

The pipe joint 8 for the coolant inlet, which is an aluminum block of a given shape having a flat top face 8*a*, is thus a joint of the flange connection type having a bore 10 which extends inwards from the top face 8*a* so as to receive the end portion of the inlet pipe 6. The diameter of the bore 10 is larger than that of the inlet pipe 6 so that the extremity of this pipe may easily slip off said bore, if inserted alone. An inner end of the bore 10 continues to a coolant passage 13 which is of a diameter smaller than that of said bore, with a shoulder 14 being formed between the bore and the passage.

A cylindrical brazing agent piece 15 is employed to braze the inlet pipe 6 to the pipe joint 8 for the inlet. The cylindrical brazing agent piece 15 has its outer and inner surfaces clad with a brazing agent layer, and may be manufactured by pressing for example an aluminum brazing sheet. The cylindrical brazing agent piece 15 intervenes between the inner peripheral wall of the pipe receiving bore 10 and the outer periphery of the extremity of the inlet pipe 6 inserted in said bore. In this state, the outer periphery of the extremity of the inlet pipe 6 is in a pressed close contact with an inner periphery of the cylindrical brazing agent piece 15, while an outer periphery thereof is similarly in close contact with the inner peripheral wall of said bore 10, whereby the end portion of said pipe 6 is fixed in the pipe receiving bore 10.

The cylindrical brazing agent piece 15 comprises a cylindrical body 15*e*, a first flange 15*a* integral with and radially extending outwards from one end of the body 15*e*, and a second flange 15*b* integral with and radially extending inwards from the other end opposite to the one end of said body 15*e*. The first flange 15*a* is designed to bear against the flat top face 8*a* of the pipe joint 8, with the second flange 15*b* being designed to rest on the shoulder 14 located deepest in the pipe receiving bore 10.

An annular edge defining an open mouth 15*c* surrounded by the first flange 15*a* of this cylindrical brazing agent piece 15 is flared so as to smoothly receive the pipe 6, and an annular corner 15*d* around the second flange 15*b* is similarly rounded to be smoothly inserted in the bore 10 of the pipe joint 8. Details of the outlet pipe 7 and the other pipe joint 9 therefor are not illustrated herein, but they may be of a structure similar to the inlet pipe and joint therefor, provided that they are of the flared connection type.

When assembling the heat exchanger, its members will be combined at first with one another to form a preassembly.

The flat tubes 1 will be arranged in parallel with one another at regular intervals in the direction of their width, before the headers 3 are attached to them by inserting both ends of each tube 1 into the tube insertion apertures of each header, and then each of the corrugated fins 2 will be interposed and set in place between two adjacent tubes 1 and 1, with the other parts such as the partitions 4 and side plates 5 also being set in place to thereby provide the preassembly of the heat exchanger body.

On the other hand, the pipe joint 8 will be attached to the inlet pipe 6. In detail, the end portion of the inlet pipe 6 will be inserted into the cylindrical brazing agent piece 15 through its first flange 15*a*, and then this cylindrical piece 15 will be inserted into the bore 10 of this pipe joint 8, with the piece's end where the second flange 15*b* is located thereby leading the cylindrical piece 15. Thus, the extremity of said pipe 6 is tightly fixed in the bore 10 of the joint 8 and is self-retained therein. In the event that cylindrical brazing agent piece 15 would incidentally be missed, the dimensional relationship between the three members or portions will prevent the pipe joint 8 from being fixed on the pipe 6. In other words, an error of missing the cylindrical brazing agent piece 15 is not likely to occur, and thus excluding a possibility that the joint 8 is connected to the pipe 6 erroneously with said piece being missed between them.

In this state of the members, the beaded portion 11 of the pipe 6 rests on the first flange 15*a* of the cylindrical brazing agent piece 15, with its second flange 15*b* being born by the shoulder 14 and at the same time said first flange 15*a* being placed on and in contact with the flat top face 7*a* of the joint 8.

Subsequently, the foot end of inlet pipe 6 to which the joint 8 has been connected will be put into the pipe-insertion aperture of the header 3 in the preassembled heat exchanger body. The outlet pipe 7 and the other joint 9 therefor will be treated with likewise. Assembly of the heat exchanger is completed in this manner.

The thus assembled heat exchanger will then be placed in a brazing oven for the flux brazing or vacuum brazing process in which the members will be consolidated with one another. The inlet pipe 6 becomes integral with the joint 8, during this brazing process and thanks to the intervening brazing agent piece 15.

It also is noted that the cylindrical brazing piece 15 interposed between the joint 8 and the pipe 6 which is forced thereinto is effective in particular to improve the sealing property of this connection.

In addition, the area of the beaded portion 11 of the pipe 6 in contact with the first flange 15*a* of the cylindrical brazing agent piece 15 in this embodiment is of an annular shape. The second flange 15*b* of said piece 15 also contacts the annular shoulder 14 in the pipe receiving bore. Further, the first flange 15*a* is in contact with an annular region of the flat top face 8*a* of the pipe joint 8. Therefore, the sealing between the pipe 6 and the joint 8 brazed thereto will further be improved.

Figure 2A:
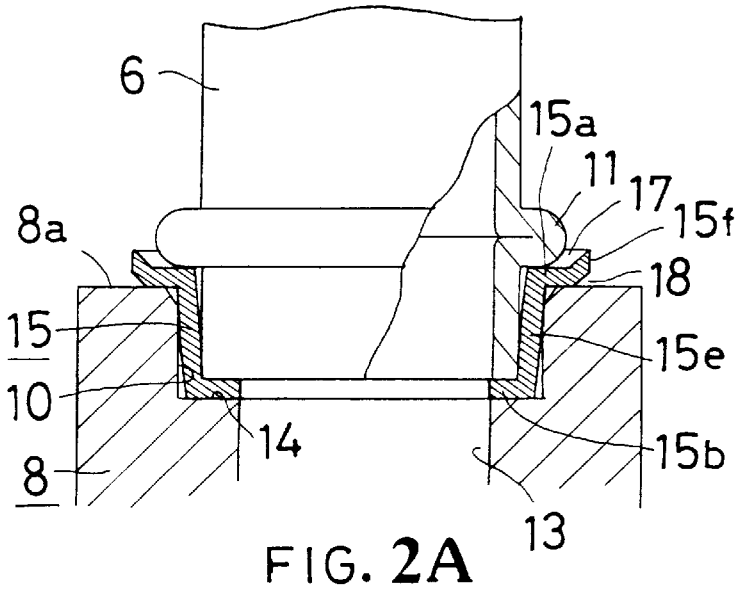
FIG. 2A is a vertical cross section of the connection.
Figure 2B:
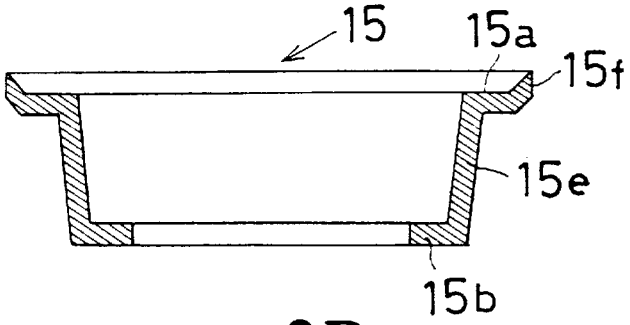
FIG. 2B is a vertical cross section of a cylindrical brazing agent piece.

In an embodiment shown in FIG. 2, a cylindrical body 15*e* of the cylindrical brazing agent piece 15 is a short tapered pipe, so that not only the insertion of the pipe 6 into this cylindrical piece 15 but also the insertion thereof into the bore 10 of the pipe joint 8 are made smoother.

An annular edge 15*f* of a first flange 15*a* in this embodiment protrudes upwardly and outwardly of the flange such that a space between the upwardly protruding edge 15*f* and the beaded portion 11 of the pipe 6, and also another space between said edge 15*f* and the flat top face 8*a* of the joint 8, do function as 'brazing agent sinks' 17 and 18 which are of an annular shape improving the brazing quality.

Figure 3:
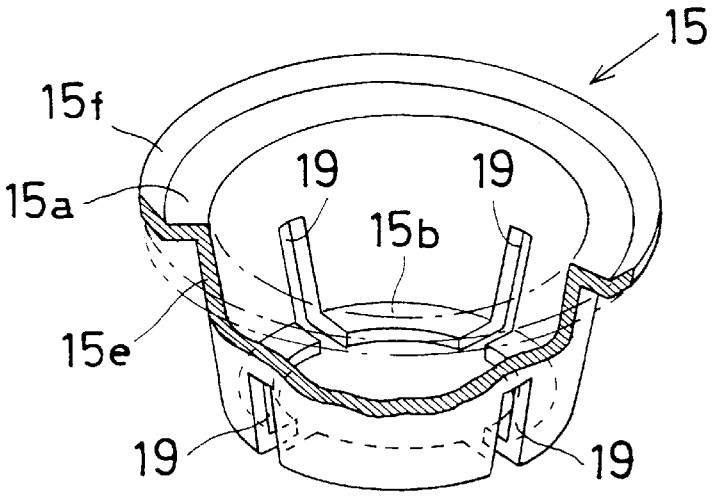
FIG. 3 is a perspective view showing partly in cross section the cylindrical brazing agent piece, in a modification of the embodiment shown in FIG. 2.

In an embodiment shown in FIG. 3, a cylindrical body 15*e* of the cylindrical brazing agent piece 15 looks like a short tapered pipe similarly to the embodiment in FIG. 2, and its region adjacent to and including the second flange 15*b* is divided into some portions by a plurality of slits 19 which are spaced apart from one another in the circumferential direction. This structure is effective to protect the cylindrical brazing agent piece 15 from its breakage when it receives the pipe 6, particularly in a case wherein said piece is the short tapered pipe.

Figure 4A:
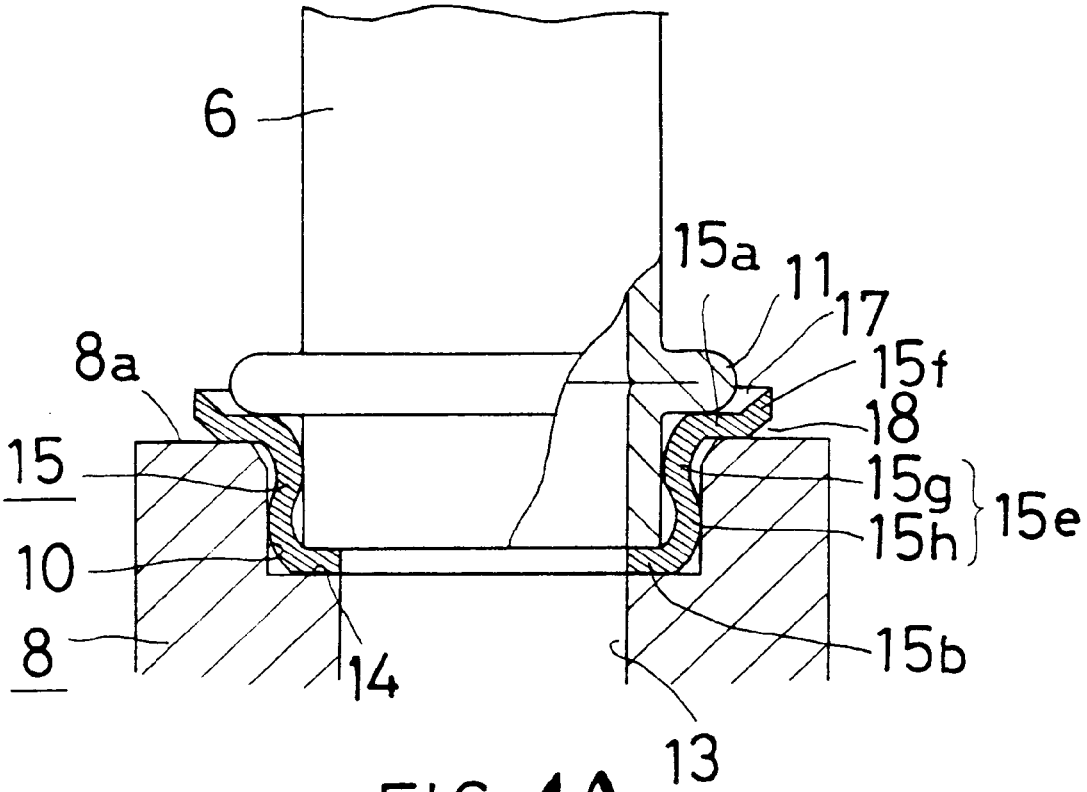
FIG. 4A is a vertical cross section of the connection.
Figure 4B:
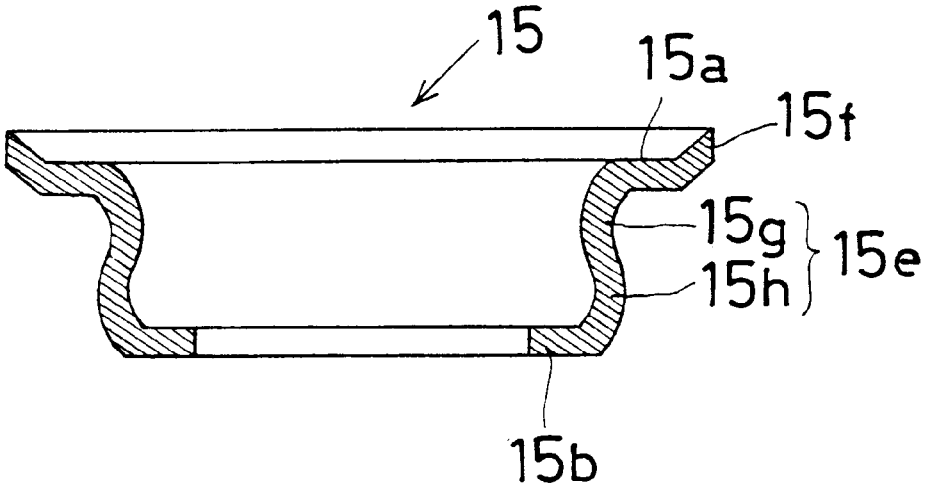
FIG. 4B is a vertical cross section of a cylindrical brazing agent piece.

In an embodiment shown in FIG. 4, a cylindrical body 15*e* of the cylindrical brazing agent piece 15 is composed of integral halves 15*g* and 15*h*, wherein the half 15*g* adjacent to the first flange 15*a* has its middle region throttled inwardly to resemble a Japanese hand drum, while the other half 15*h* adjacent to the second 15*a* has its middle region expanded outwardly to resemble a barrel. This brazing agent piece 15 is such that its hand drum-shaped half 15*g* comes into a forced contact with the pipe 6, and its barrel-shaped half 15*h* comes into a forced contact with the inner peripheral wall of the bore 10 in the joint 8, both the contacts extending all around the bore. Thus, a perfect sealing will be ensured between the pipe 6 and the joint 8 brazed thereto.

Figure 5:
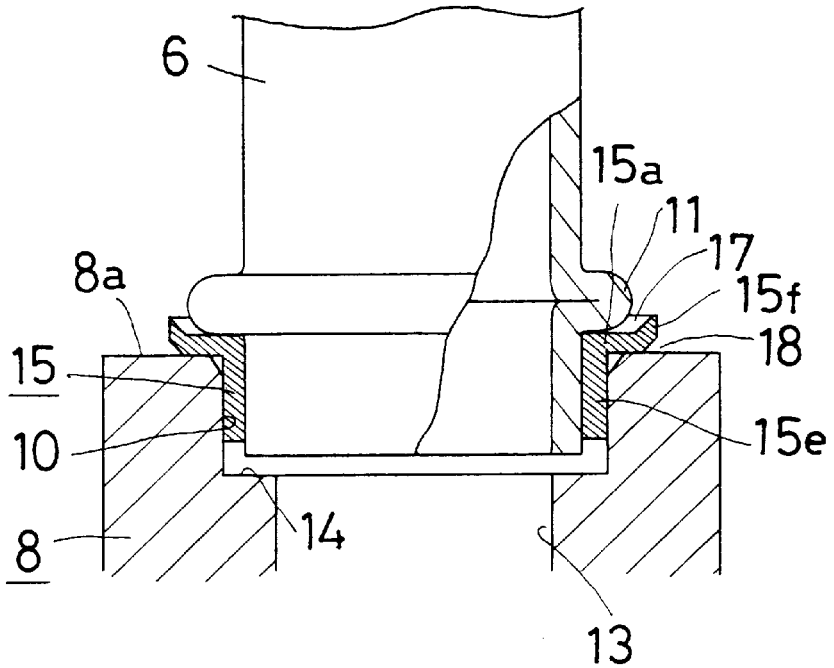
FIG. 5 is a cross section showing the connection in yet still another embodiment.

In an embodiment shown in FIG. 5, the cylindrical brazing agent piece 15 has an inner end devoid of the second flange 15*b*, so that the inner end of this piece 15 inserted in the bore 10 of the joint 8 terminates short of the shoulder 14 in said bore 10. Further, the beaded portion 11 protrudes from the pipe 6 such that the pipe's inner end also inserted in the bore 10 terminates short of the shoulder 14 formed therein. Due to this feature, the beaded portion 11 of said pipe 6 surely comes into annular contact with the first flange 15*a* of the cylindrical brazing agent piece 15, notwithstanding a slight dimensional error in manufacture of those members, with this flange 15*a* also coming into annular contact with the flat top face 8*a* of the joint 8, whereby a perfectly sealed connection of those members is realized.

Figure 6:
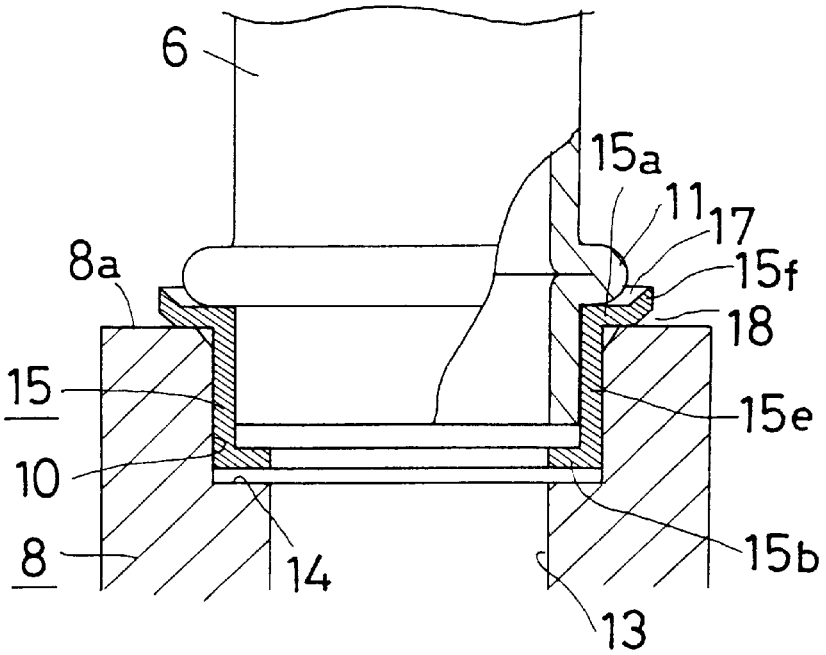
FIG. 6 is a cross section showing the connection in a further embodiment.

In an embodiment shown in FIG. 6, the cylindrical brazing agent piece 15 and the pipe 6 pushed into the joint 8, with this piece 15 intervening between them, are of such a shape and dimension that the pipe's inner end is located to provide a space between it and the shoulder 14 in the bore 10, and the second flange 15*b* of the cylindrical brazing piece 15 is positioned in this space, apart from the pipe's inner end and the shoulder. This structure, similarly to the case shown in FIG. 5, is advantageous in that the beaded portion 11 of said pipe 6 surely comes into annular contact with the first flange 15*a* of the cylindrical brazing agent piece 15, notwithstanding a slight dimensional error in manufacture of those members, with this flange 15*a* also coming into contact with an annular region around the entrance opening of bore 10 formed in the joint 8, whereby a perfectly sealing of the brazed members is realized.

Figure 7A:
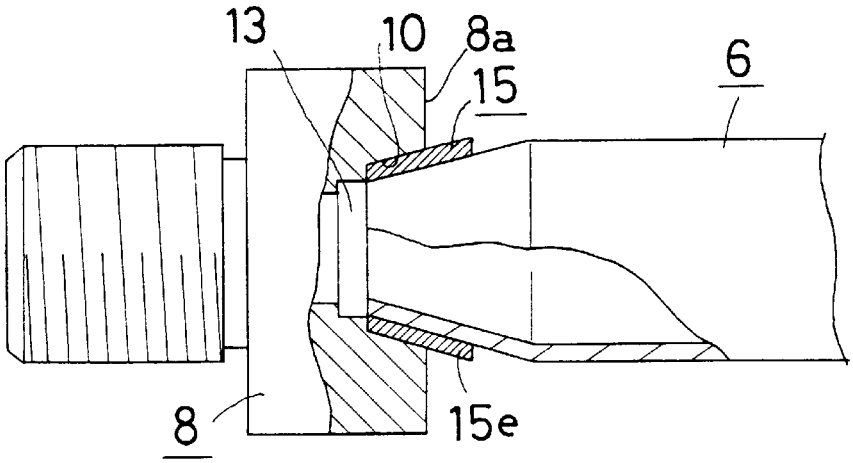
FIG. 7A is a vertical cross section of the connection.
Figure 7B:
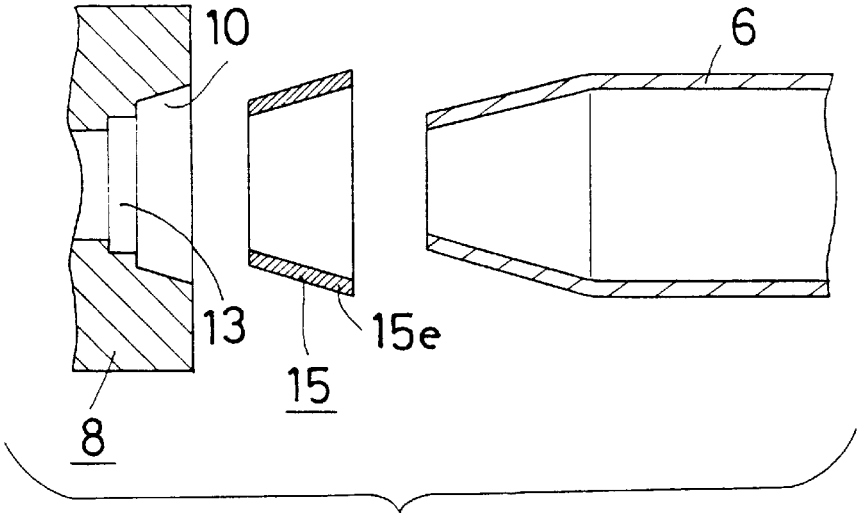
FIG. 7B is a cross section showing, in disassembled state, the inlet pipe, the pipe joint and the cylindrical brazing agent piece.
Figure 8:
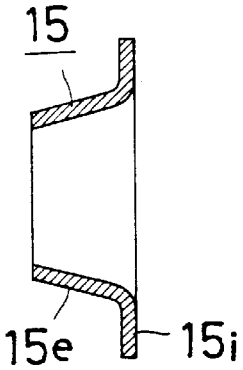
FIG. 8 is a vertical cross section of the cylindrical brazing agent piece, in a modification of the embodiment shown in FIG. 7.

In an embodiment in FIG. 7, a joint 8 of the flared type is employed. The pipe insertion bore 10 of this joint is a tapered bore whose diameter decreases towards the bottom of this bore. The cylindrical brazing agent piece 15, which has in this case neither a first flange 15*a* nor a second flange 15*b*, is also shaped to be a short tapered pipe. Further, the pipe 6 also has an end which is tapered to reduce its diameter towards its extremity, corresponding to the inner periphery of the cylindrical brazing piece 15. This pipe's end will be pressed into the bore 10 of the joint 8, also with said brazing piece 15 intervening between them. In such a structure, the pipe 6 is in close and broader contact with the cylindrical brazing agent piece 15, and this piece 15 also is in close and broader contact with the joint 8, thereby producing a sure sealing between the pipe 6 and the joint 8 brazed thereto. The cylindrical brazing agent piece 15 in this embodiment may be manufactured by pressing a plate so as to have a flange 15*i* as illustrated in FIG. 8.

Since the pipe for flowing the heat exchanging medium is brazed to the pipe joint by means of the cylindrical brazing agent piece 15, any clad pipe coated with a brazing agent need not be used, but a cheaper bare pipe suffices which advantageously makes inexpensive the connection of the pipe joint to the pipe.

Since the end of each connection pipe is pressed into engagement with the cylindrical bore in the pipe joint, with the cylindrical brazing agent piece being sandwiched between the outer periphery of said end and the inner periphery of said bore, a failure to set the cylindrical piece in place will prevent the pipe end from being fixed in the joint to form a stable preassembly, so that this cylindrical brazing piece will never be missed by an assembling worker and the connection pipes are surely brazed to the pipe joints.

INDUSTRIAL APPLICABILITY

The present invention is adapted for an application to a heat exchanger which is made of a metal such as aluminum and for use as the heat exchanger employed in the air conditioning system such as the car cooler and room air conditioner.

We claim:

1. A heat exchanger comprising: a heat exchanger body; a connection pipe extending therefrom for flowing a heat exchanging medium, the connection pipe including a beaded portion extending outwardly of the rest of the connection pipe; a pipe joint having a cylindrical bore for receiving an end portion of the connection pipe; and a cylindrical brazing agent piece with a portion interposed between an outer periphery of the end portion and an inner periphery of the bore and with another portion interposed between the beaded portion and an area adjacent the bore on the pipe joint for brazing the beaded portion to the adjacent area; the inner periphery of the bore, the outer periphery of the end portion, and the portion of the brazing agent interposed therebetween defining a plurality of cavities around the end portion of the connection pipe when the pipe, the joint and the agent are assembled before brazing; wherein the end portion of the connection pipe is forcibly and tightly fitted in the cylindrical bore and is brazed integral therewith due to the interposed cylindrical brazing agent piece.

2. A heat exchanger as defined in claim 1, wherein the connection pipe is a bare pipe which is not clad with a brazing agent layer.

3. A heat exchanger as defined in claim 1, wherein the pipe joint is a block of a given shape for flange connection, and the block has a flat top face which is formed with the cylindrical bore penetrating the top face.

4. A heat exchanger as defined in claim 1, wherein the cylindrical bore is of a diameter larger than that of the connection pipe so that the end portion of the connection pipe inserted in the bore may freely slip out of the bore.

5. A heat exchanger as defined in claim 1, wherein an inner end of the cylindrical bore continues to a passage for the medium, with the passage being of a diameter smaller than that of the bore, and a shoulder is formed between the inner end and the passage.

6. A heat exchanger as defined in claim 1, wherein the cylindrical brazing agent piece is made of a clad material having its both surfaces clad with a brazing agent layer.

7. A heat exchanger as defined in claim 6, wherein the clad material is composed of an aluminum core sheet having both surfaces clad with the brazing agent layer, and the cylindrical brazing agent piece is a pressed product of the clad material.

8. A heat exchanger as defined in claim 1, wherein the cylindrical brazing agent piece comprises a cylindrical body which has a first flange and a second flange, with the first flange extending radially and outwardly from an end of the cylindrical body, and with the second flange extending radially and inwardly from another end of the cylindrical body.

9. A heat exchanger as defined in claim 8, wherein the cylindrical body of the cylindrical brazing agent piece is shaped as a tapered short pipe.

10. A heat exchanger as defined in claim 8, wherein the first flange of the cylindrical brazing agent piece has an annular oblique protrusion extending outwardly and upwardly from the annular outer edge of the first flange.

11. A heat exchanger as defined in claim 8, wherein the cylindrical body of the cylindrical brazing agent piece is shaped as a tapered short pipe, and the cylindrical body has an inner portion including the second flange and divided by a plurality of slits which are spaced apart from one another.

12. A heat exchanger as defined in claim 8, wherein the cylindrical body of the cylindrical brazing agent piece is composed of a half adjacent to the first flange and another half integral with the half and adjacent to the second flange, wherein the former half having its middle portion throttled inwardly is of a shape resembling a Japanese hand drum, with the latter half having its middle portion expanded outwardly is of a shape resembling a barrel.

13. A heat exchanger as defined in claim 1, wherein the pipe joint is a block of a given shape for flange connection, and the block has a flat top face which is formed with the cylindrical bore penetrating the face, with the block further having a shoulder formed at a deepest region of the bore, wherein the cylindrical brazing agent piece comprises a cylindrical body which has a first flange and a second flange, with the first flange extending radially and outwardly from an end of the cylindrical body, and with the second flange extending radially and inwardly from another end of the cylindrical body, and wherein the second flange rests on the shoulder, with the first flange bearing against the flat top face of the joint.

14. A heat exchanger as defined in claim 1, wherein the cylindrical brazing agent piece comprises a cylindrical body which has a first flange extending radially and outwardly from one end of the cylindrical body, and a second flange extending radially and inwardly from other end opposite to the one end of the cylindrical body, such that an inner end of said connection pipe in the bore terminates short of a shoulder formed at an innermost region of the cylindrical bore, and such that the second flange of the cylindrical brazing agent piece is interposed between the inner end of said pipe and the shoulder in the pipe insertion bore.

15. A heat exchanger as defined in claim 1, wherein the cylindrical brazing agent piece comprises a cylindrical body having a flange which extends radially and outwardly from an end of the cylindrical body.

* * * * *